US010424864B2

(12) United States Patent
Hoppmann et al.

(10) Patent No.: US 10,424,864 B2
(45) Date of Patent: Sep. 24, 2019

(54) PATCHBOARD

(71) Applicant: Phoenix Contact GmbH & Co. KG, Blomberg (DE)

(72) Inventors: Ralph Hoppmann, Bad Oeynhausen (DE); Marcel Willems, Blomberg (DE); Henning Vieregge, Extertal (DE); Holger Steinhage, Steinheim (DE); Oliver Pethig, Hespe (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 16/091,650

(22) PCT Filed: Apr. 6, 2017

(86) PCT No.: PCT/EP2017/058257
§ 371 (c)(1),
(2) Date: Oct. 5, 2018

(87) PCT Pub. No.: WO2017/174724
PCT Pub. Date: Oct. 12, 2017

(65) Prior Publication Data

US 2019/0157795 A1 May 23, 2019

(30) Foreign Application Priority Data

Apr. 8, 2016 (DE) ..... 10 2016 106 479

(51) Int. Cl.
*H01R 13/514* (2006.01)
*H01R 13/506* (2006.01)
(Continued)

(52) U.S. Cl.
CPC ..... *H01R 13/514* (2013.01); *H01R 13/506* (2013.01); *H01R 43/22* (2013.01); *H01R 43/26* (2013.01)

(58) Field of Classification Search
CPC ..... H01R 13/514
See application file for complete search history.

(56) References Cited

U.S. PATENT DOCUMENTS 4,046,452 A 9/1977 Cassarly
4,469,393 A 9/1984 Chewning, Jr. et al.
(Continued)

FOREIGN PATENT DOCUMENTS

DE 4430358 A1 4/1995
DE 19512226 A1 10/1996
(Continued)

*Primary Examiner* — James Harvey
(74) *Attorney, Agent, or Firm* — David S. Safran; Roberts Mlotkowski Safran Cole & Calderon, P.C.

(57) ABSTRACT

A patchboard having multiple honeycomb components, each honeycomb component having a box-shaped housing with two end surfaces and four lateral surfaces which extend between the end surfaces. Each of the end surfaces has at least one connection region, and each of the lateral surfaces has at least one connection element for connecting to another honeycomb component. Individual honeycomb components can be removed from the patchboard in that at least one respective elastic latching arm with a latching hook is arranged on at least two mutually adjacent lateral surfaces of the honeycomb components. Each of the latching arms extends in the direction of the length of each lateral surface, and at least one recess is formed at least on the lateral surfaces on which at least one latching arm is formed, the recess being used to access the latching hook of a latching arm from an end face using a tool.

9 Claims, 11 Drawing Sheets

(51) Int. Cl.
*H01R 43/22* (2006.01)
*H01R 43/26* (2006.01)

(56) References Cited

U.S. PATENT DOCUMENTS

| | | | | |
|---|---|---|---|---|
| 4,611,879 | A | 9/1986 | Bullard | |
| 6,432,545 | B1 | 8/2002 | Schicht et al. | |
| 9,577,365 | B1 * | 2/2017 | Herbrechtsmeier | H01R 13/518 |
| 2014/0196925 | A1 | 7/2014 | Kowtun et al. | |
| 2014/0357095 | A1 | 12/2014 | Kute | |
| 2019/0027858 | A1 * | 1/2019 | Goto | H01R 13/62938 |
| 2019/0067888 | A1 * | 2/2019 | Ljubijankic | H01R 12/716 |
| 2019/0081433 | A1 * | 3/2019 | Kropiewnicki | G01R 33/07 |

FOREIGN PATENT DOCUMENTS

| | | | |
|---|---|---|---|
| DE | 102008015554 | A1 | 10/2009 |
| DE | 202009009900 | U1 | 10/2009 |
| DE | 102014101528 | A1 | 8/2015 |
| EP | 1091380 | A1 | 4/2001 |
| EP | 2930794 | A1 | 10/2015 |

* cited by examiner

PATCHBOARD

BACKGROUND OF THE INVENTION

Field of the Invention

The invention relates to a patchboard with several socket blocks, the individual socket blocks each having a box-shaped housing with two end faces and four side faces which extend between the end faces, and the two end faces of the socket blocks each having at least one terminal region, the side faces of the socket blocks each having at least one connecting element for connection to another socket block, the connecting elements which are made on opposite side faces being made and arranged corresponding to one another and the connecting elements each having a longitudinal extension which runs parallel to the longitudinal extension of the respective side face.

In addition, the invention relates to a socket block for building a patchboard as well as a tool for removing a socket block from a patchboard.

Description of Related Art

To connect electrical leads, for decades, electrical terminal blocks have been used of which several are generally latched next to one another on a mounting rail, several mounting rails which are equipped in this way with terminal blocks often being located in a control cabinet. Since a relatively large amount of space remains unused between the individual mounting rails, in particular where a plurality of electrical leads must be connected in a very narrow space, patchboards are often used. For this reason, patchboards are known from practice in which within a fixed rectangular mounting frame there are a plurality of socket blocks in corresponding chambers of the frame. Electrical conductors can be connected to the patchboard or individual socket blocks both from the front, the field side, and also from the back, the station side. To do this, in the box-shaped housings of the individual socket blocks there are terminal elements which are generally connected to one another via corresponding conductor bars so that an electrical conductor which has been inlet through a corresponding conductor inlet opening in the front end face can be electrically joined to an electrical conductor or a terminal contact which has been inlet through a corresponding inlet opening in the rear end face of the housing.

For example, German Patent Application DE 195 12 226 A1 discloses one such patchboard with a plurality of socket blocks. In the patchboard disclosed in this document the individual socket blocks which have been inserted in the individual chambers of the mounting frame all have the same dimensions. On their upper and lower edge side one mounting flange tongue at a time is tightly joined to the patchboard, via which the patchboard can be fastened by means of screws on a mounting frame. It is not possible to adapt the patchboard to individual wishes of the user in this known patchboard. If the number of conductors to be connected has to be increased, a correspondingly larger patchboard with a larger number of individual socket blocks must be used, in practice patchboards with 18, 32, 48, 54 or 80 socket blocks being available.

German Patent Application DE 10 2014 101 528 A1 discloses a patchboard which is characterized by increased flexibility and the possibility of adapting the patchboard to individual wishes. This is achieved by the individual side faces of the socket blocks each having at least one locating element for connecting to another socket block. The locating elements which are made on opposing side faces are made and arranged corresponding to one another so that the socket blocks can be directly connected to one another. In this way the use of a rigid mounting frame which fixes the number of individual socket blocks can be eliminated so that the patchboard can fundamentally have any number of socket blocks.

The socket blocks known from German Patent Application DE 10 2014 101 528 A1 on their individual side faces have drop-in pins which can be inserted into corresponding locating holes on the opposite side face of an adjacent socket block. Moreover, the socket blocks each have on one side face two locating hooks which can be hooked into longitudinal locating holes which are made on the opposing side face. Both the drop-in pins and also the locating hooks extend perpendicular to the longitudinal extension of the respective side face so that the patchboard must be disassembled line by line or column by column After connecting of the individual socket blocks, a very stable patchboard which enables signal distribution on an extremely small space is enabled.

A patchboard in which likewise the use of a mounting frame can be omitted is also disclosed by German DE 35 87 796 T2 corresponds to U.S. Pat. No. 4,611,879. In this patchboard on which this invention is based, on the side faces of the individual socket blocks several ridges are made to which on the opposite side face of the socket blocks there are corresponding grooves. The ridges and grooves each run parallel to the longitudinal extension of the respective side face, i.e., in the extension direction from one end face to the other end face. Two socket blocks which are located next to one another can thus be easily connected by the ridges on the side face of one socket block being inserted into the corresponding grooves on the opposite side face of the other socket block. Projections made on the grooves provide for two socket blocks not being able to be displaced against one another in the longitudinal direction of the side faces after connecting.

In order to reliably connect to one another two socket blocks which have been connected in this way, in the known patchboard there are separate fastening elements in the form of interlocking wedges which are pushed into a recess which is made between two connected socket blocks. To form the recess, in their side faces the socket blocks each have notches which are opposite one another and which are made dovetailed. The interlocking wedge has a bilaterally dovetailed cross section corresponding thereto. Moreover, on one front end of the interlocking wedge a locating hook is made which provides for latching of the interlocking wedge in the recess when it has been pushed fully into the recess between two socket blocks.

In the patchboard known from the prior art, the locating elements made on the individual socket blocks thus optionally together with separate fastening elements provide for a reliable and stable connection of the individual socket blocks to one another so that a stable patchboard is formed without a corresponding mounting frame being necessary. But the disadvantage is that due to the completed latching of the individual socket blocks to one another, disassembly of the patchboard is either not possible at all or is only possible with increased effort. The dismounting of a socket block which is not located directly on the edge of the patchboard is as poorly possible as the insertion of a new socket block in the interior of the patchboard so that the replacement of individual defective socket blocks is not possible or is possible only with increased effort.

SUMMARY OF THE INVENTION

Therefore, the object of this invention is to provide a patchboard with several socket blocks in which even in the assembled state individual socket blocks can be removed from the patchboard with little effort. In doing so the patchboard will have high stability overall. Moreover, a corresponding socket block for building a patchboard as well as a tool for simple removal of a socket block from a patchboard will be made available.

This object is achieved in a patchboard according to the invention in that, on at least two bordering side faces of the socket blocks, there is at least one elastic locating arm with a locating hook at a time, the locating arms each extending in the direction of the longitudinal extension of the respective side face, and that at least on the side faces on which at least one locating arm is made at least one recess is made in the side face by which the locating hook of a locating arm is accessible by means of a tool from an end side of the socket block.

By making at least one connecting element on all four side faces of the socket blocks, the connecting elements which are made on opposite side faces being made corresponding to one another, one socket block can be connected to another socket block both in the x direction and the y direction. Adjacent socket blocks of a patchboard can be fixed relative to one another both in the x direction and also in the y direction by the construction of the connecting elements. In order to moreover reliably connect and fasten the socket blocks to one another also in the z direction, in the socket blocks of the patchboard as claimed in the invention there are elastic locating arms which are located on at least two bordering side faces of the socket blocks. Because on two bordering side faces of the socket blocks there is at least one elastic locating arm each, two socket blocks can also be fastened to one another in the z direction, regardless of whether the second socket block is located in the x direction or in the y direction next to the first socket block.

Fastening or latching between two adjacent socket blocks takes place by the locating hook of the elastic locating arm of one socket block engaging the locating hook of the elastic locating arm of the adjacent socket block. Two socket blocks which are to be connected to one another must for this reason be arranged relative to one another such that they are opposite one another with one side face on which one locating arm at a time is made.

For example, so that a defective socket block can be removed again from the patchboard with little effort in the patchboard as claimed in the invention, a recess in the side face is made at least on the side faces on which a locating arm is made. The recess in the side face which is made preferably as a U-shaped groove makes it possible for the locating hook of a locating arm to be accessible to a tool from the end side even if two socket blocks are connected to one another. A tool can thus be introduced into the recess from one end side of the socket block so that the locating arm is deflected, and in this way, the latching between the locating hooks of two socket blocks can be neutralized.

Since two socket blocks which are connected to one another via the locating arms are opposite one another with their side faces on which not only the locating arm, but also the recess is made, the two opposite recesses in the two side faces form an opening large enough for a tool between the side faces of two socket blocks. The tool can be for example the tip of a screwdriver. But preferably a special tool is used with which the latching of one socket block can be especially easily neutralized and the socket block can be removed from the patchboard.

In order to accomplish the fastening of two socket blocks interconnected via a locating arm not only opposite the joining direction of the two socket blocks, but also in the joining direction, on the individual connecting elements corresponding stops or edges can be made, as are also provided for the ridges and grooves of the socket blocks known from DE 35 87 796 T2 and corresponding to U.S. Pat. No. 4,611,879. But preferably, the construction of these stops or edges is omitted so that the connecting elements do not prevent displacement of two socket blocks relative to one another in the z direction. This has the advantage that mounting of the individual socket blocks is then possible not only in one direction.

Displacement of two socket blocks relative to one another in the longitudinal extension of the respective side faces is preferably prevented in the patchboard by there being, on at least two bordering side faces of the socket blocks, two elastic locating arms with one locating hook at a time. The two locating arms are located next to one another viewed in the longitudinal extension of the respective side face, the locating arms extending in opposite directions. Moreover, the locating arms are made and arranged such that their ends overlap with the locating hooks in the longitudinal extension.

If two socket blocks are being connected to one another, in which on the opposite side faces there are two such elastic locating arms at a time, this leads to the two pairs of locating hooks formed by the total of four locating arms or locating hooks crossing in the center of the side faces of the socket blocks. Displacement of two socket blocks which have been connected to one another in this way parallel to the longitudinal extension of the two opposing side faces is then no longer possible so that the two socket blocks are reliably latched to one another in the z direction.

It was stated in the introduction that on at least two bordering side faces of the socket blocks there is at least one elastic locating arm each. According to one advantageous configuration of the invention at least one elastic locating arm, preferably two elastic locating arms at a time, is made not only on two side faces, but on all four side faces of the individual socket blocks. Corresponding thereto then on all side faces of the socket blocks there are also corresponding recesses in the side faces so that the latching by the locating arms between adjacent socket blocks can be neutralized by introducing a tool into the corresponding recess between two side faces of two socket blocks.

According to another especially advantageous configuration of the invention, on each side face of the socket blocks at least one groove and at least one ridge which corresponds to the groove are made as connecting elements, the ridges and grooves each preferably having a dovetailed cross section. The at least one groove on one side face of one socket block is arranged mirror-symmetrically to the ridge on the opposite side face of the socket block so that when two socket blocks are connected to one another one ridge at a time on one side face of one socket block engages the corresponding groove on the opposite side face of the other socket block. At the same time, a respective groove on one side face of one socket block together with one ridge on the opposite side face of the other socket block forms a corresponding mechanical connection. Between two interconnected socket blocks there are then at least two connections, in particular at least two tongue-in-groove connections.

If the individual connecting elements in the peripheral direction of the individual socket blocks each have the same distance to one another, individual socket blocks can also be joined to one another via the connecting elements which correspond to one another even if the socket blocks are turned by 90° around their center axis. Each side face of one socket block can then be connected to any side face of another socket block.

The aforementioned object is achieved in a socket block by on each of at least two bordering side faces there being at least one elastic locating arm with a locating hook, the locating arms each extending in the longitudinal extension of the respective side face, and that at least on the side faces on which at least one locating arm is made at least one recess for a tool is made in the side face. With respect to the advantages of this socket block, reference is made to the previous statements on the patchboard in accordance with the invention.

The recess in the side face of the socket block on which a locating arm is made is made preferably in the manner of a groove, in particular a U-shaped groove, so that it is a unilaterally open recess. This leads to the fact that for two interconnected socket blocks on whose opposite side faces at least one locating arm and one recess are made, an opening for a tool accessible from one end side is available and is formed by the two recesses which are mirror-symmetrically opposite one another. Even for relatively small dimensions of an individual socket block, in this way a large enough opening can be made available so that, for example, the tip of a screwdriver, as a tool, can be inserted so far into the opening that the tip of the screwdriver can neutralize the latching between two locating arms.

There are various possibilities with respect to the construction of the locating arms made on the individual side faces of the socket block. Preferably the locating arm is made such that it extends away from the corresponding side face at a small angle so that the locating arm proceeding from its base region which is connected to the side wall in the direction of the locating hook has a distance to the side face which becomes greater.

According to another configuration, the locating arm has a first section and a connected second section, the first section being connected with its first end to the side face and the locating hook being made on the free end of the second section. The locating arm is made here such that the two sections extend at different angles to the side face on which the locating arm is fastened. In particular, the locating arm is made such that it is only deflected when a tool with its actuating tip meets the second section of the locating arm. This results in that the point at which the actuating tip of the tool applies a force to the locating arm is spaced apart from the fulcrum of the locating arm. Between the fulcrum of the locating arm, therefore the point at which the locating arm is connected to the side face, and the point of force application a lever is thus formed. The distance between the point of force application and the fulcrum corresponds essentially to the length of the first section of the locating arm so that the first section acts as a lever arm. The force which is necessary for the deflection of the locating arm can be reduced in this way. At the same insertion force moreover the load on the fulcrum of the locating arm is smaller compared to a locating arm in which the point of force application has only a short distance to the fulcrum. This reduces the risk of damage to the locating arm, in particular the locating arm breaking off at the fulcrum.

According to another advantageous configuration of the patchboard in accordance with the invention, the locating hooks of the locating arms are located in the region of the center of the side faces relative to the longitudinal extensions of the side faces. This makes it possible for a tool to be inserted alternatively from the front or from the rear end face into the recess to remove a socket block from a patchboard, since the distance of the locating hooks to both side faces is at least roughly the same. Preferably the connecting elements, i.e., the grooves and ridges made on the side faces, are interrupted in the region of the locating hooks so that only the locating arms are made in the central region; this facilitates the production of the socket block. The connecting elements are located in the front and back region of the side faces and the locating arms are located in the central region.

As has already been stated, the tool for neutralizing the latching between two locating hooks of two socket blocks can be essentially any tool which is suitable in terms of its dimensions, in particular the tip of a screwdriver. In particular, when a socket block is connected to several adjacent socket blocks via several locating arms located on different side faces, it is however advantageous if instead of several individual tools a single tool can be used with which several latches can be neutralized at the same time.

According to another teaching of the invention, for this purpose there is a tool for removing a socket block from a patchboard that has at least two release arms and one handle section from which the release arms extend, the release arms being arranged relative to one another such that they can be inserted into two recesses at the same time on two different side faces of one socket block.

According to one advantageous configuration of the tool in accordance with the invention, it has a total of four release arms which are located distributed symmetrically on the handle section, the positions of the release arms being chosen such that the release arms, in a socket block with four recesses, can be inserted into all four recesses in one of the four side faces. If the handle section has an annular base surface, the four release arms are arranged each offset by 90° to one another on the handle section, the extension direction of the release arms running perpendicular to the base surface of the handle section.

To remove one socket block which according to one advantageous configuration has two elastic locating arms on the individual side faces at a time, the individual release arms of the tool preferably have two release fingers which are located next to one another in the longitudinal extension of the release arms. With the two release fingers of one release arm one pair of locating hooks at a time between two interconnected socket blocks can be released. Preferably, the release fingers with their free ends each have a bevel which is made corresponding to the bevel of the locating hooks, as a result of which the deflection of the locating arms is facilitated and the risk of canting of a release finger on a locating hook is reduced.

If according to the preferred configuration, the tool has four release arms, a socket block to be removed from the patchboard by the tool is surrounded on its four side faces by one release arm which has been inserted in a corresponding recess in the side face. In order to easily and reliably pull the socket block out of the patchboard after the individual locating connections are broken, according to another preferred configuration on at least one release arm of the tool a locating hook is made which extends preferably essentially perpendicular to the longitudinal extension of the release arm. In the fully inserted state of the release arm into the recess in one side face of the socket block the locating hook reaches behind a corresponding edge on the socket block, as a result of which latching between the tool and the socket block is accomplished, by which the socket block can be easily withdrawn from the patchboard together with the tool.

In order to ensure especially reliable latching between the tool and the socket block, a locating hook is made preferably each of at least on two opposing release arms. It is apparent to one skilled in the art here that alternatively to the construction of a locating hook on one release arm, a corresponding locating hook can also be made in a recess of the socket block. Then, on at least one release arm, a corresponding locating recess is made which is engaged by the locating hook when the release arm has been fully inserted into the recess in the side face of the socket block.

In particular, there is a host of possibilities for configuring and developing the patchboard as in accordance with the invention as well as the socket block and the tool as will be apparent from the following description of preferred exemplary embodiments in conjunction with the accompanying drawings.

BRIEF DESCRIPTION OF THE DRAWINGS

FIG. 5 shows the patchboard according to FIG. 1 with the tool pushed in.

DETAILED DESCRIPTION OF THE INVENTION

Figure 1:
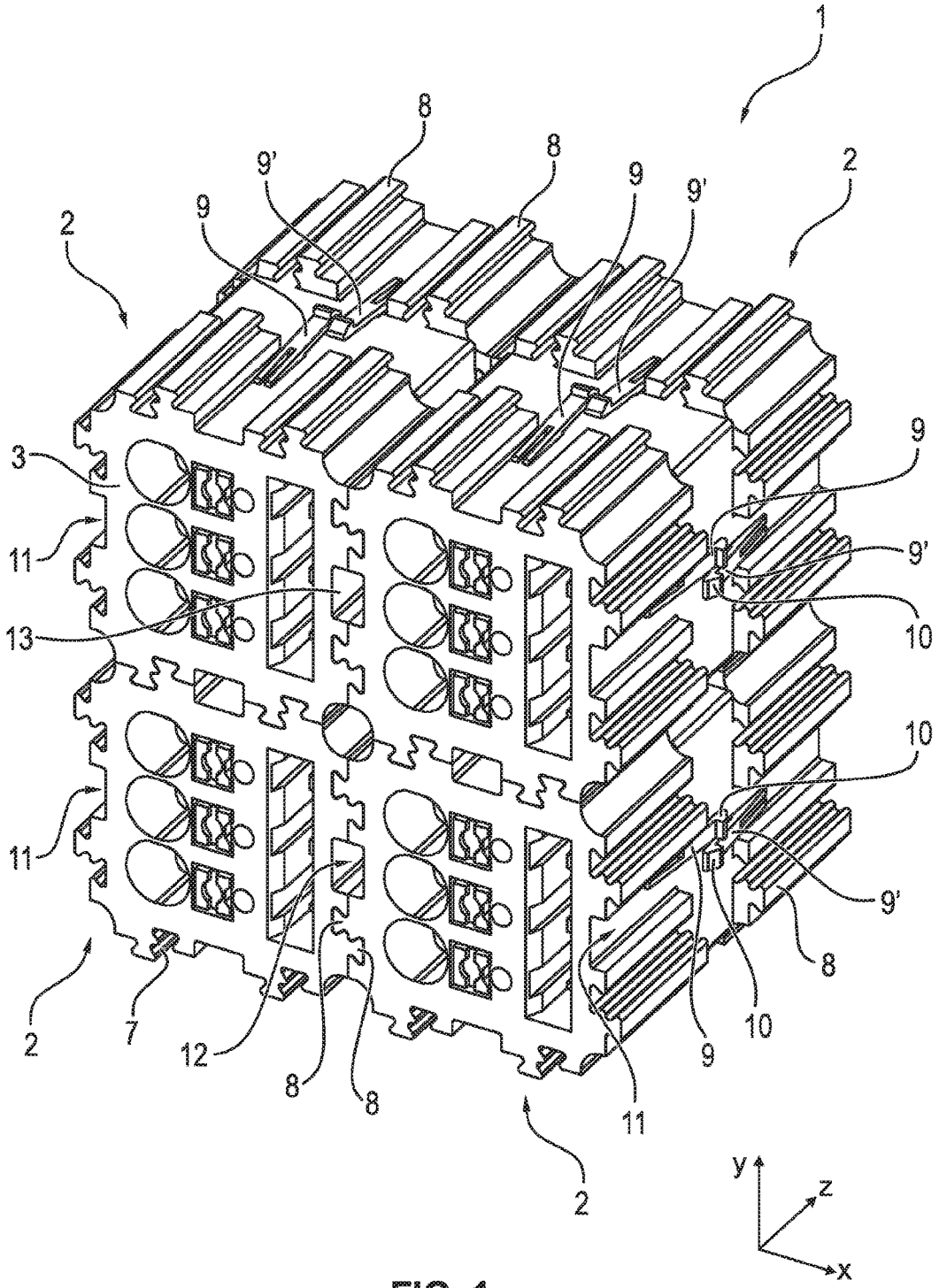
FIG. 1 shows one exemplary embodiment of a patchboard composed of four socket blocks, in a perspective.

FIG. 1 shows one exemplary embodiment of a patchboard 1 which is formed of four socket blocks 2, the individual socket blocks 2 being directly connected to one another. The patchboard 1 can however also be assembled from many more socket blocks 2, the individual socket blocks 2 being arranged relative to one another such that each socket block 2 is or at least can be connected to at least one further socket block 2 both in the x direction and also in the y direction.

The individual socket blocks 2 each have a box-shaped housing 3 with two end faces 4*a*, 4*b* and four side faces 5*a*, 5*b*, 5*c* and 5*d*. The individual side faces 5*a*, 5*b*, 5*c*, 5*d* extend between the two end faces 4*a*, 4*b* and each have an angle of 90° to the end faces 4*a*, 4*b*. One socket block 2 thus has an essentially rectangular cross section, here the individual socket blocks 2 being made even square and all having the same dimensions without however the invention being limited thereto. Moreover, the socket blocks 2 have a length or depth which runs in the longitudinal extension of the respective side faces 5*a*, 5*b*, 5*c*, 5*d* and thus in the z direction.

On the front end face 4*a* of the socket blocks 2 there are three terminal regions 6 which are preferably made as spring force clamping terminals. Within the housing 3 there are then three clamping springs, by means of the clamping springs one stripped conductor which has been inserted through a respective conductor inlet opening of one terminal region 6 can be clamped against a conductor bar which is likewise located in the housing 3 and can in this way be connected in an electrically conductive manner to the conductor bar. The rear end face 4*b* can likewise have three terminal regions. But in addition it is also possible for the two end faces 4*a*, 4*b* to have a different number of terminal regions, the rear end face 4*b* for example has only two terminal regions. Likewise, the end faces 4*a*, 4*b* can also have more or fewer than the three terminal regions shown in the figures.

To connect the socket blocks 2 among one another, the socket blocks 2 on all four side faces 5*a*, 5*b*, 5*c*, 5*d* have several connecting elements 7, 8. In this way one socket block 2 can be connected to another socket block 2 on all four side faces 5*a*, 5*b*, 5*c*, 5*d* and thus both in the x direction and also in the y direction in order to build a corresponding patchboard 1. In the exemplary embodiment shown in FIGS. 1 and 2*a*, 2*b* the socket blocks 2, as is in particular apparent from the enlargement according to FIG. 2, on all four side faces 5*a*, 5*b*, 5*c*, 5*d*, each have two dovetailed grooves 7 and two dovetailed ridges 8. The grooves 7 on one side face 5*a*, 5*b*, 5*c*, 5*d* are arranged mirror-symmetrically to the ridges 8 on the opposite side face 5*b*, 5*a*, 5*d*, 5*c* so that for two socket blocks 2 which have been connected to one another the grooves 7 and ridges 8 of one side face 5*b* of one socket block 2 engage the ridges 8 and grooves 7 of the opposite side face 5*a* of the adjacent socket block 2.

Since both the grooves 7 and also the ridges 8 extend parallel to the longitudinal extension of the respective side face 5*a*, 5*b*, 5*c*, 5*d*, the two socket blocks 2 are connected to one another by the socket blocks 2 with their respectively opposite grooves 7 and ridges 8 being pushed into one another in the z direction. The mounting direction thus runs parallel to the longitudinal extension of the side faces 5*a*, 5*b*, 5*c*, 5*d*. Here the mounting direction also corresponds to the actuating direction of the terminal regions 6, i.e., to the direction in which the conductors to be connected are inserted into the terminal regions 6.

In the patchboard 1 shown in the figures, the individual socket blocks 2 are tightly joined to one another in the x direction and y direction by the individual dovetailed ridges 8 being pushed into the corresponding grooves 7. Displacement of the socket blocks 2 relative to one another in the z direction is conversely not prevented by the grooves 7 and ridges 8 since the grooves 7 and ridges 8 all extend parallel to the longitudinal extension of the respective side face 5*a*, 5*b*, 5*c*, 5*d* and there are no stops or edges which would limit a displacement in the z direction. So that the individual socket blocks 2 of a patchboard 1 cannot be displaced relative to one another also in the z direction, the socket blocks 2 in the embodiment according to FIG. 2 on each of the side faces 5*a*, 5*b*, 5*c*, 5*d*, there are two elastic locating arms 9, 9' on whose free end a respective locating hook 10 is provided.

Figure 2A:
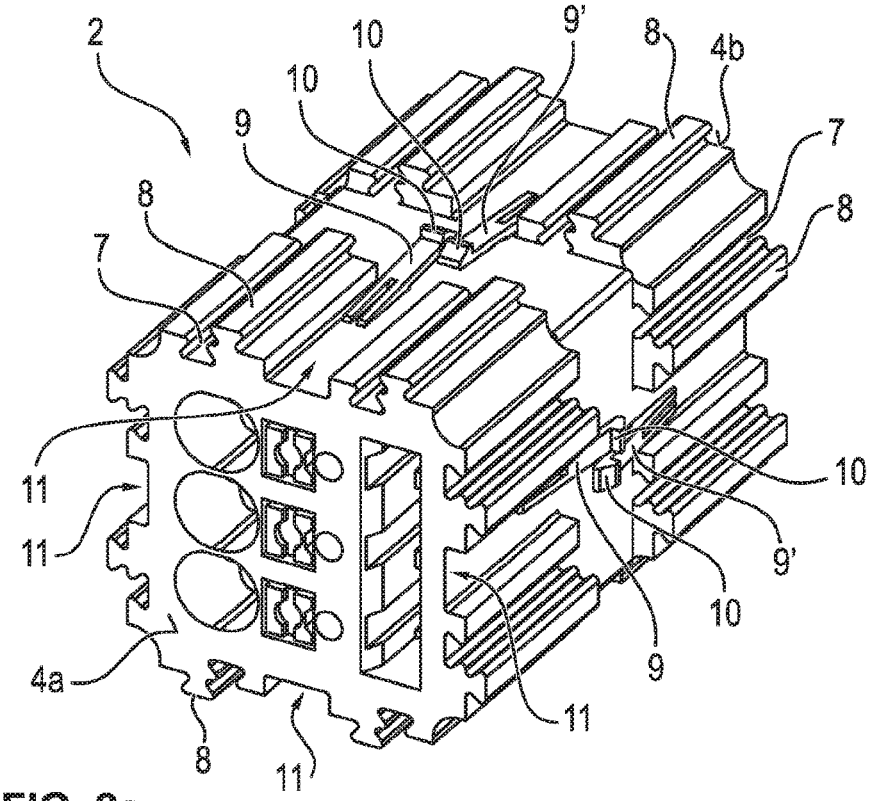
FIGS. 2*a* and 2*b* show an enlargement of an individual socket block of a patchboard, in a perspective and from the front.
Figure 2B:
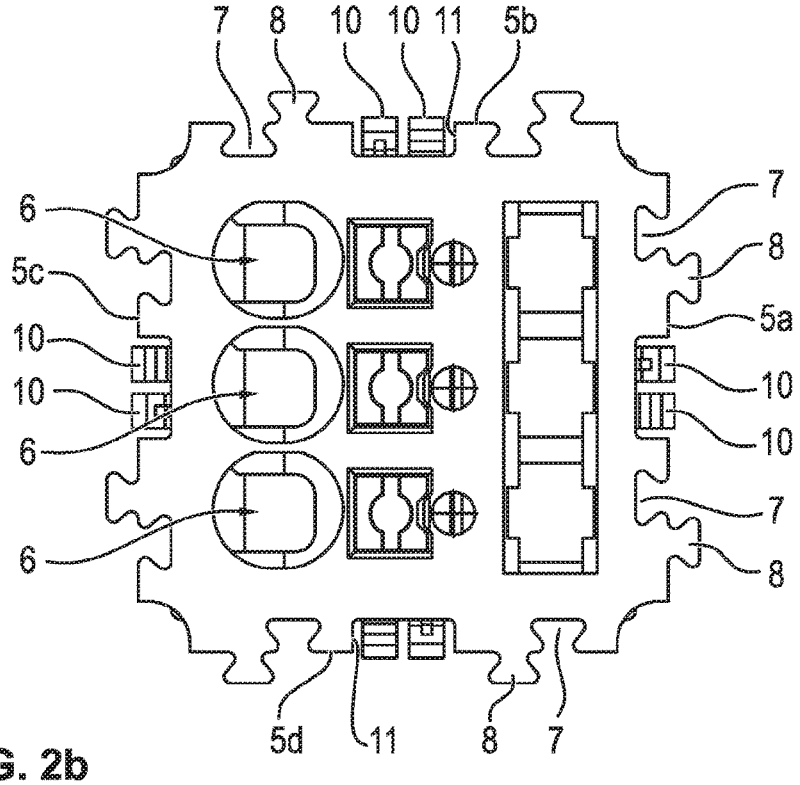
Figure 3A:
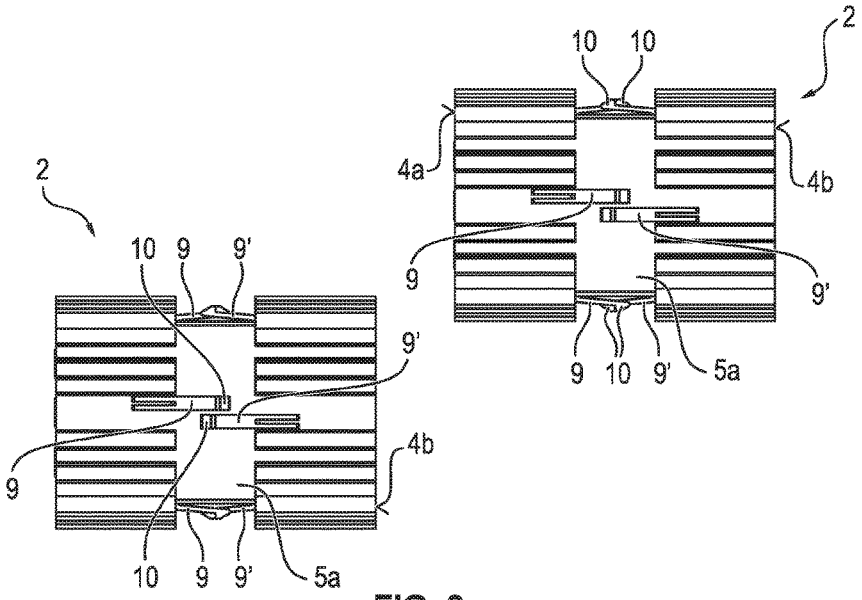
FIGS. 3*a* and 3*b* show two socket blocks from the side, before and after being pushed together.

As is apparent from the enlargement of a socket block 2 according to FIGS. 2*a*, 2*b* the locating arms 9, 9' each extend essentially in the longitudinal extension of the respective side face 5*a*, 5*b*, 5*c*, 5*d*. The two locating arms 9, 9' made on one side face are located next to one another in the longitudinal extension of the respective side face 5*a*, 5*b*, 5*c*, 5*d*, as is also apparent from the side view according to FIGS. 3*a* 3*b*. FIGS. 2*a* and 3*a* moreover show that the two locating arms 9, 9' extend in the opposite direction, and that their ends overlap with the locating hook 10 in the longitudinal extension. One locating hook 9 thus extends proceeding from its base region connected to the side face 5*a* in the direction of the rear end face 4*b*, while the other locating arm 9' proceeding from its base region extends in the direction of the front end face 4*a*. Since, as stated above, the ends of the locating arms 9, 9' overlap with their locating hooks 10 in the longitudinal direction, the locating hook 10 of one locating arm 9 is located somewhat farther to the rear in the z direction and the locating hook 10 of the other locating arm 9' is located somewhat farther to the front; this is also easily apparent from the side view of the socket blocks 2 according to FIG. 3*a*.

Figure 3B:
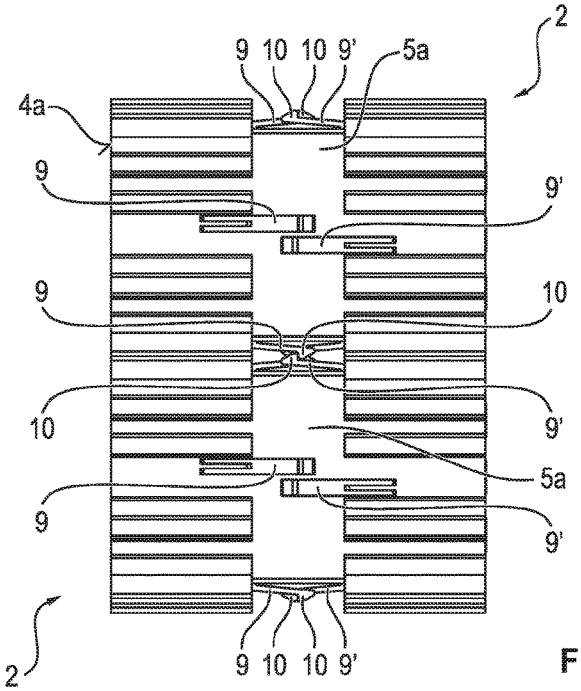
Figure 4:
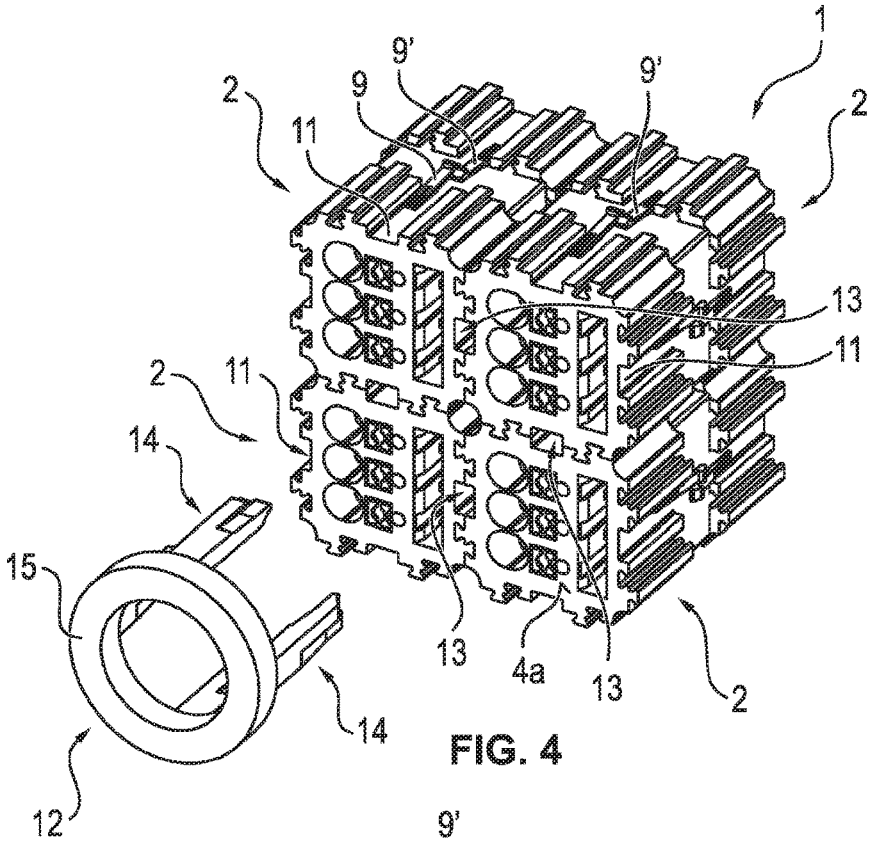
FIG. 4 shows the patchboard according to FIG. 1, with a separate tool for removing a socket block from the patchboard.
Figure 5:
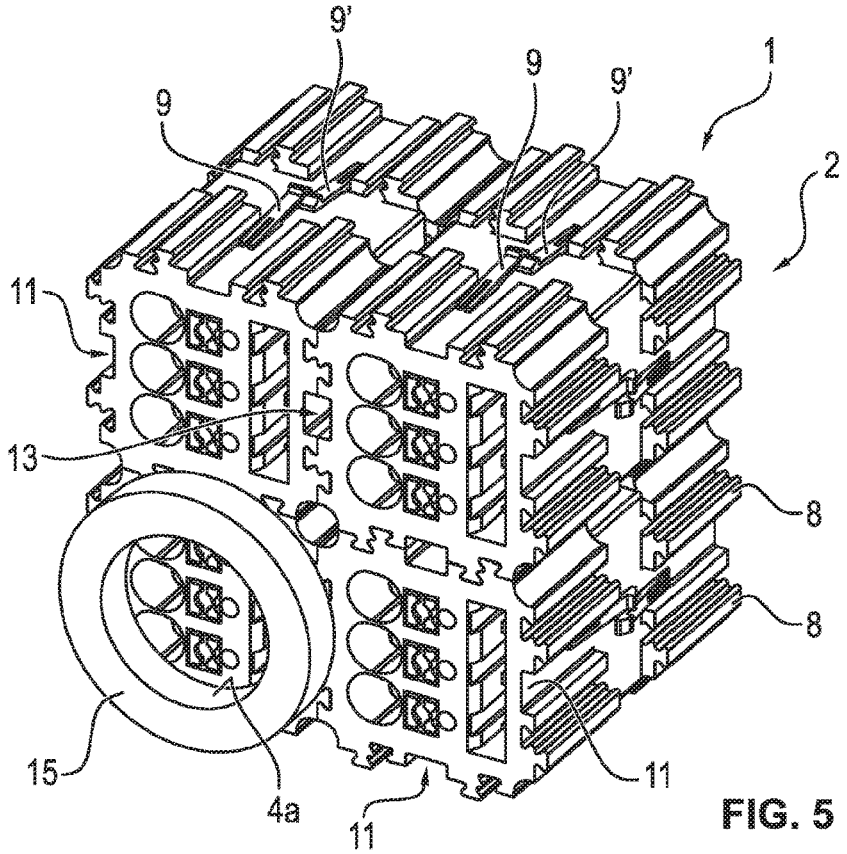

As is especially apparent from FIG. 3*b*, in the joined state of two socket blocks 2 the pairs of locating hooks formed by the total of four locating arms 9, 9' or locating hooks 10 cross one another so that displacement of the socket blocks 2 relative to one another in the z direction is not possible; the two socket blocks 2 are thus also latched to one another in the z direction.

Figure 10A:
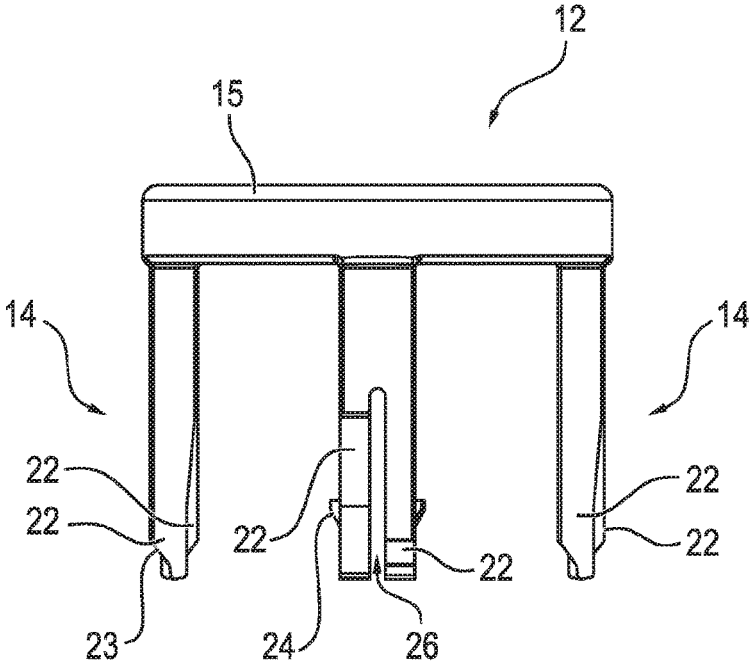
Figure 10B:
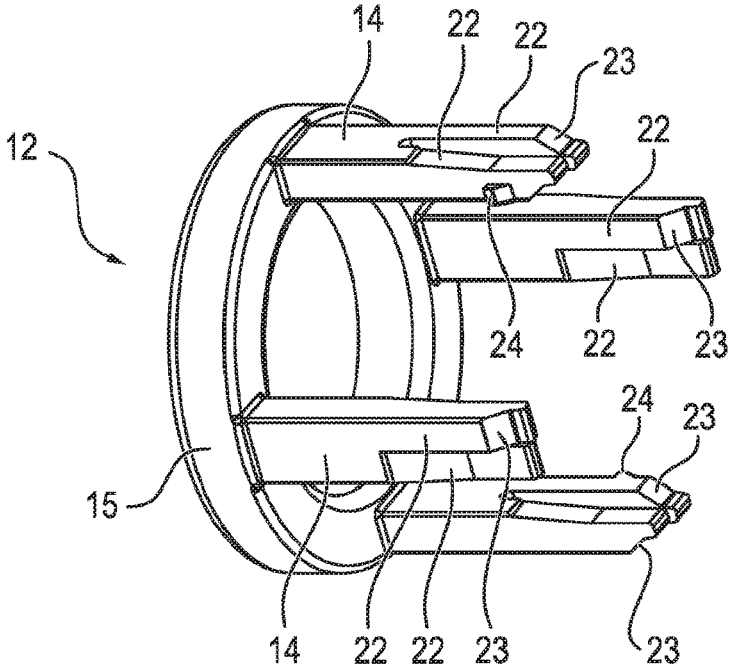

So that in the patchboard 1 in accordance with the invention, in spite of the above described reliable latching of the socket blocks 2 to one another, nevertheless a socket block 2 can also be removed from the patchboard 1 with little effort since a respective groove-shaped recess 11 is provided on each of the side faces 5*a*, 5*b*, 5*c*, 5*d* of the individual socket blocks 2. This makes it possible to insert a tool 12 for neutralizing the latching into the opening 13 formed by two opposite recesses 11 between two socket blocks 2, as is shown in FIGS. 4 to 6,7*a*, 7*b* and 8*a*, 8*b*. Preferably, the latching between the two locating hooks 10 of two locating arms 9 and 9' is not neutralized by means of the tip of a screwdriver, which would also be fundamentally possible, but rather using a special tool 12 which is shown in FIGS. 4 to 6 and 9*a*, 9*b* together with the patchboard 1 or one socket block 2 and separately in FIGS. 10*a*, 10*b*.

The tool 12 for removing a socket block 2 from a patchboard 1 according to the preferred configuration shown in the figures has four release arms 14 which are located on a common annular handle section 15. The release arms 14 extend here perpendicular to the base surface of the handle section 15, the release arms 14 being located distributed symmetrically on the handle section 15 so that the release arms 14 each extend into a recess 11 on a side face 5*a*, 5*b*, 5*c*, 5*d* of one socket block 2 when the tool 12 according to FIGS. 5*a*, 5*b* is connected to the socket block 2 which is to be removed. The annular handle section 15 rests flat on the end face 4*a* of the socket block 2, the diameter of the handle section 15 being only slightly larger than the dimensions of the end face 4*a* of the socket block 2. In this way, conductors which are connected to the adjacent socket blocks 2 need not be removed from the terminal regions 6 when one socket block 2 is to be removed from the patchboard 1 using the tool 12.

Figure 6:
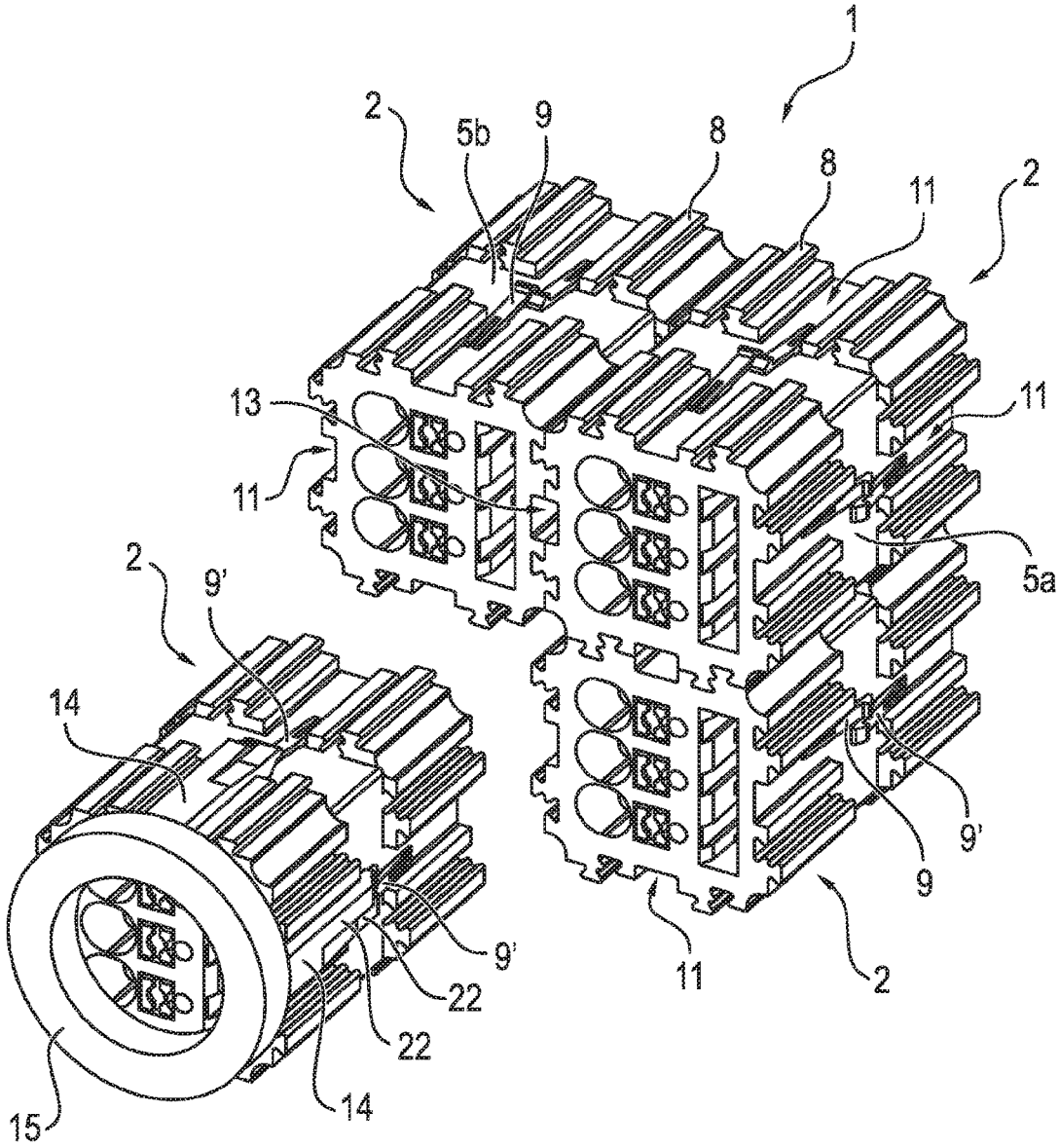
FIG. 6 shows the patchboard according to FIG. 1 with a socket block which has been removed using the tool.
Figure 7A:
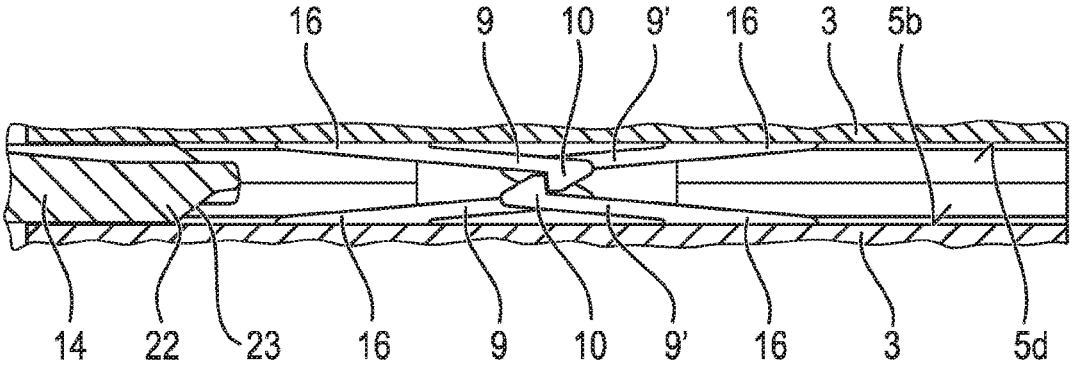
FIGS. 7*a* and 7*b* show a section of a latching region between two socket blocks, respectively with a partially and with a fully inserted tool.
Figure 7B:
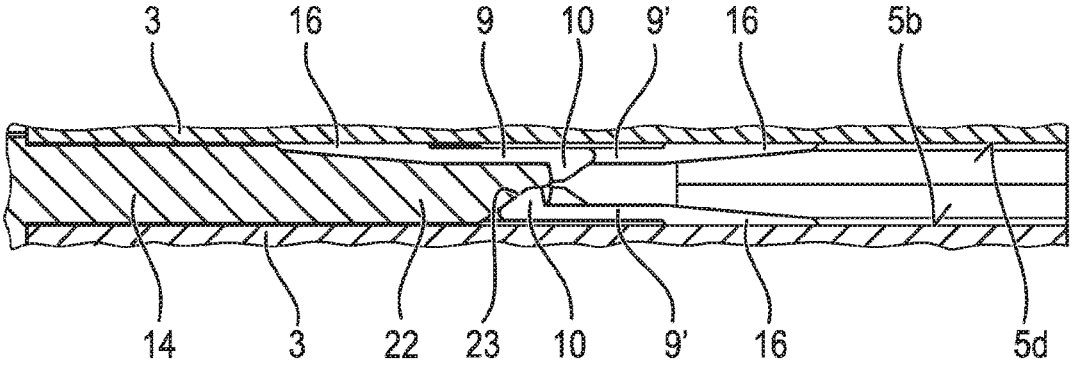

The two representations according to FIGS. 7*a*, 7*b* and 8*a*, 8*b* show how the latching between the locating hooks 10 of the individual locating arms 9, 9' of two interconnected socket blocks 2 is neutralized when one release arm 14 is inserted into the opening 13 formed by the two opposite recesses 11 between two socket blocks 2. If one release arm 14 has been fully inserted into the opening 13, the locating arms 9, 9' of the two socket blocks 2 are deflected to such an extent that the locating hooks 10 which correspond to one another are no longer engaged to one another, as is apparent from FIGS. 7*b* and 8*b*. Since then the latching between two socket blocks 2 is neutralized in the z direction, the socket block 2 together with the tool 12 can be removed from the patchboard 1, as is shown in FIG. 6.

FIGS. 7*a*, 7*b* and 8*a*, 8*b* both show a section of the latching region between two socket blocks 2, the illustrated socket blocks 2 differing from one another by the construction of the locating arms 9, 9'. While the locating arms 9, 9' shown in FIGS. 7*a*, 7*b* each have only one section which proceeding from its base region 16 which is connected to the side face 5 extends at a small angle to the corresponding side face 5 as far as the locating hook 10 located on the free end, the locating arms 9, 9' shown in FIG. 8 each have a first section 17 and a connected second section 18. The first section 17 with its first end 19 is connected to the respective side face 5 of the socket block 2, while the locating hook 10 is made on the free end of the second section 18.

As FIG. 8 shows, the first section 17 of the locating arm 9 runs essentially parallel to the side face 5, while the second section 18 has an angle to the side face 5 so that the locating hook 10 of the locating arm 9 of one socket block 2 engages the corresponding locating hook 10 of the locating arm 9 of the other socket block 2. The construction of the locating arms 9, 9' according to FIG. 8 leads to a locating arm 9, 9' only being deflected when the tip of the release arm 14 of the tool 12 meets the second section 18 of the locating arm 9, 9'. Between the point of force application and the point at which the locating arm 9 is connected to the side face 5 there is thus a distance which corresponds essentially to the length of the first section 17 of the locating arm 9. Thus between the point of force application and the fulcrum 20 of the locating arm 9, 9' a lever arm is formed, as a result of which the forces which arise on the fulcrum 20 are reduced when the locating arm 9, 9' is deflected.

Figure 8A:
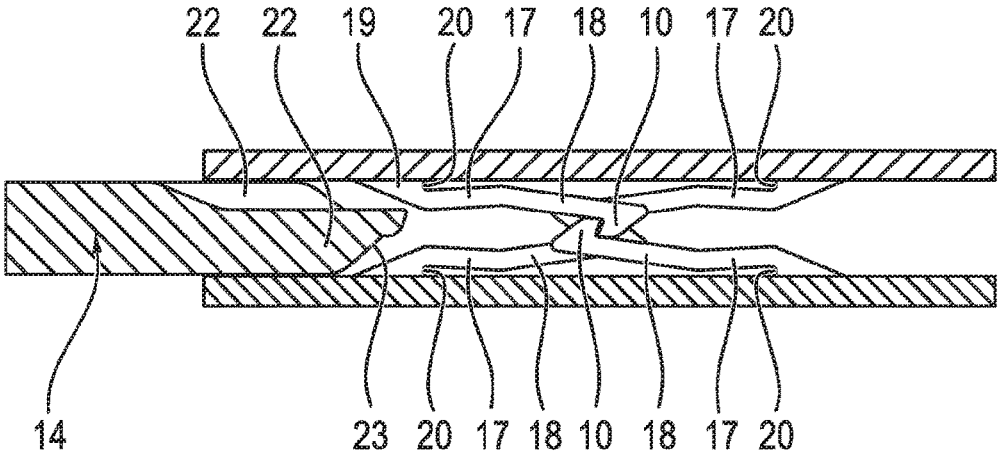
FIGS. 8*a* and 8*b* show a section of the latching region between two socket blocks which have a locating arm which has been made differently compared to FIG. 7, respectively, with a partially inserted and with a fully inserted tool.
Figure 8B:
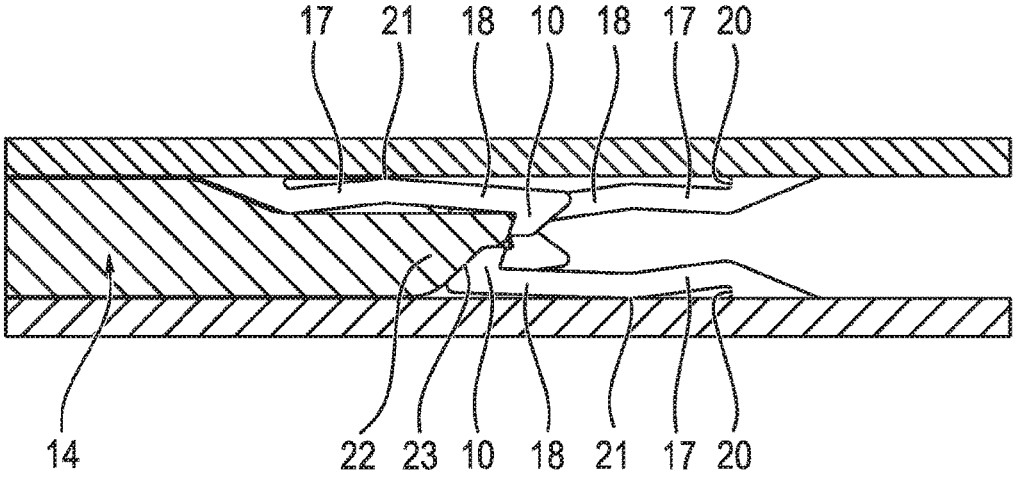
Figure 9A:
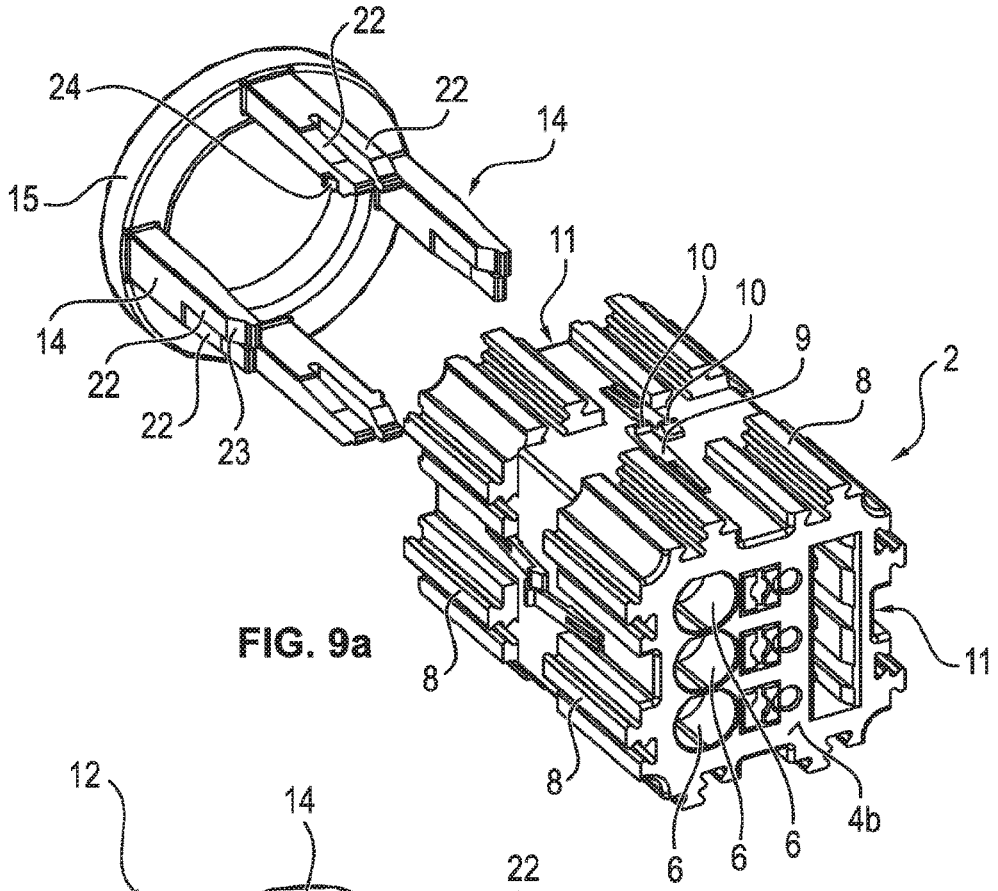
FIGS. 9*a* and 9*b* show are perspective views of the socket block according to FIG. 2 with a tool, respectively before and after the tool is pushed on, FIGS. 10*a* and 10*b* show an enlarged view of one preferred exemplary embodiment of a tool, from the side and in a perspective, respectively.
Figure 9B:
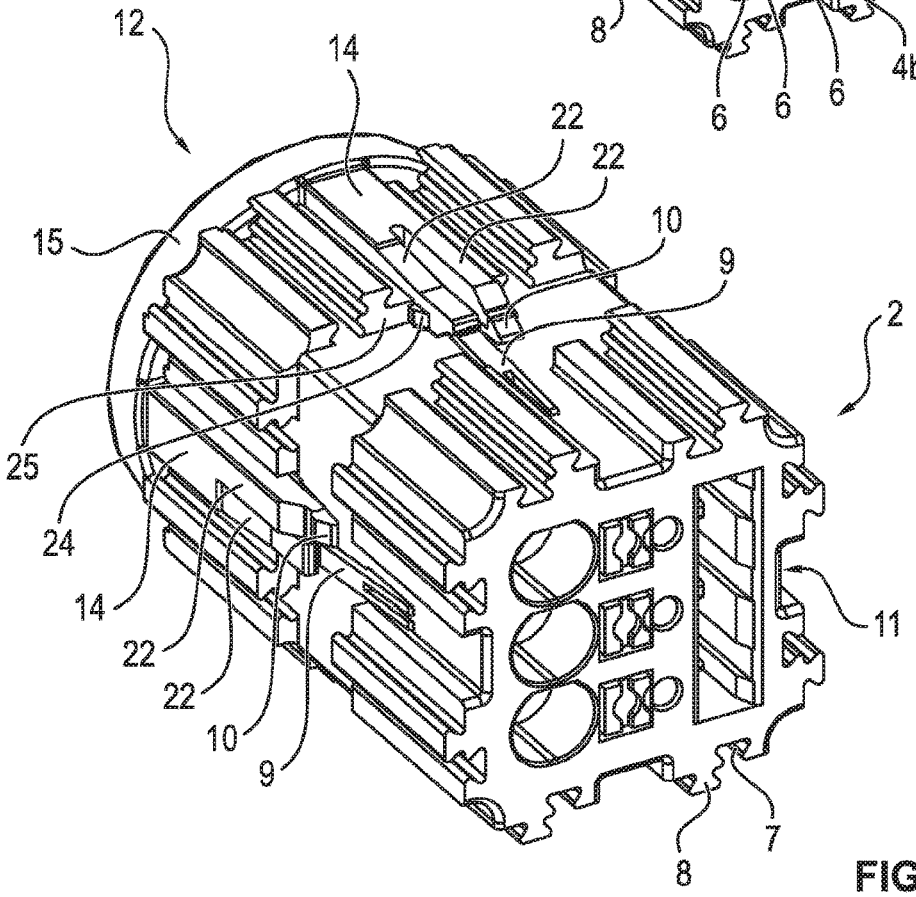

Moreover, FIG. 8*b* shows that in the transition region from the first section 17 to the second section 18 a bearing region 21 is made which adjoins the side face 5 of the socket block 2 when the locating arm 9 is being deflected so that the bearing region 21 then acts as a second fulcrum. This leads to further unloading of the first fulcrum 20 and thus of the region in which the locating arm 9 is connected to the side face 5 of the socket block 2.

The enlargement of the tool 12 according to FIGS. 9*a*, 9*b* and 10*a*, 10*b* shows that the release arms 14 of the tool 12 each have two release fingers 22 which are located next to one another in the longitudinal extension of the release arms 14. On the free ends of the release fingers 22 one bevel 23 at a time is made which is aligned in a manner corresponding to the bevel of the locating hook 10. The two release fingers 22 are used to release the latching of the two locating arms 9, 9' which are located next to one another. For this purpose, the bevels 23 on the free ends of the release fingers 22 are each located on opposing sides of the release fingers 22; this corresponds to the construction of the bevels on the locating hooks 10.

So that the tool 12 is not unintentionally removed from the socket block 2 when a socket block 2 is being pulled out of the patchboard 1, between the socket block 2 and the tool 12 additional latching is formed. For this purpose, preferably on two release arms 14 laterally on one release finger 22 at a time one locating hook 24 is made which in the positioned state of the tool 12 extends behind a corresponding edge 25 on the socket block 2. So that the insertion of a release arm 14 into a recess 11 is not made overly difficult by the construction of the locating hook 24 laterally on the release finger 22, between the two release fingers 24 a gap 26 is made so that the release fingers 22 can spring to the inside, therefore onto one another upon insertion into the recess 11.

Figure 11A:
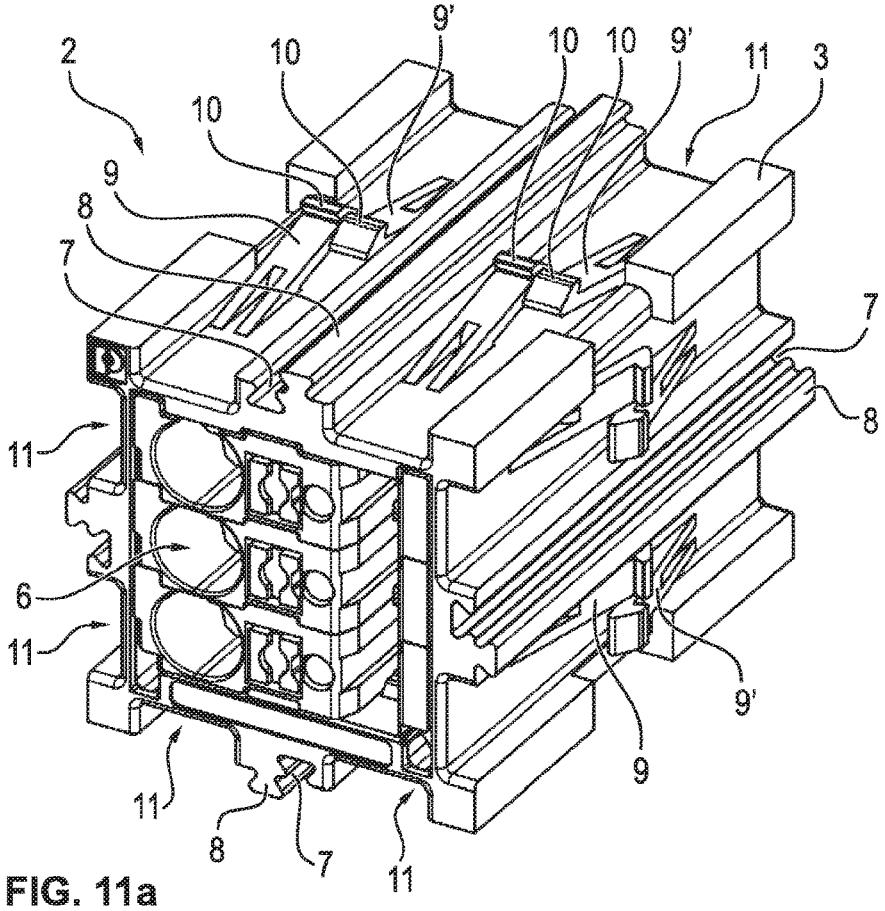
FIGS. 11*a* and 11*b* show an enlarged view of a second exemplary embodiment of an individual socket block of a patchboard, in a perspective view and from the front, respectively
Figure 11B:
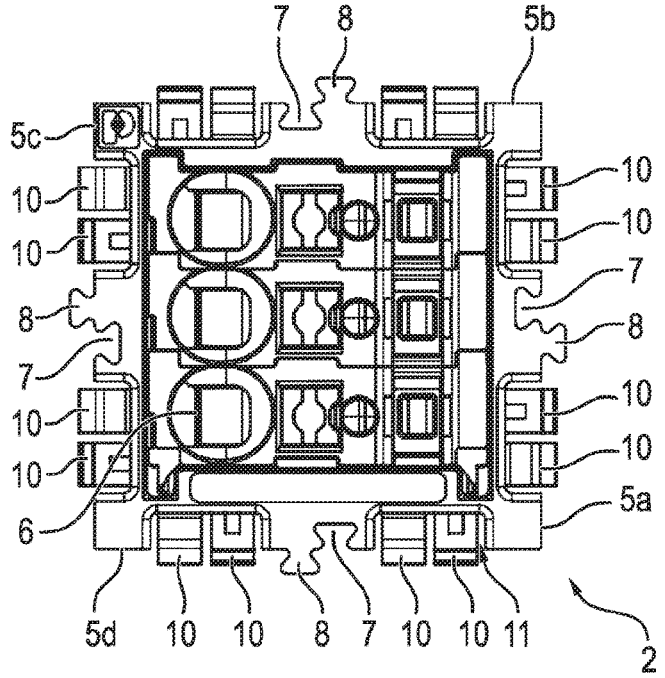

FIGS. 11*a*, 11*b* show a second exemplary embodiment of a socket block 2 in which in contrast to the socket block 2 shown in particular in FIG. 2 on the individual side faces 5*a*, 5*b*, 5*c*, and 5*d* only one dovetailed groove 7 and corresponding thereto also only one dovetailed ridge 8 are made. The groove 7 and the ridge 8 extend over the entire length of the respective side face 5*a*, 5*b*, 5*c*, 5*d*, the groove 7 and the ridge 8 being made centrally on the side face. Moreover, in the exemplary embodiment of the socket block 2 shown in FIG. 11*a*, 11*b* there are four elastic locating arms 9, 9' each on the individual side faces 5*a*, 5*b*, 5*c*, 5*d*, the locating arms 9, 9' each being located in pairs on one side of the groove 7 or of the ridge 8. In a manner corresponding to the arrangement of the respective locating arms 9, 9', on the side faces 5*a*, 5*b*, 5*c*, 5*d* one recess 11 at a time is made so that the individual side faces 5*a*, 5*b*, 5*c*, 5*d* each have two recesses 11 in the exemplary embodiment of the socket block 2 shown in FIG. 11.

Figure 12A:
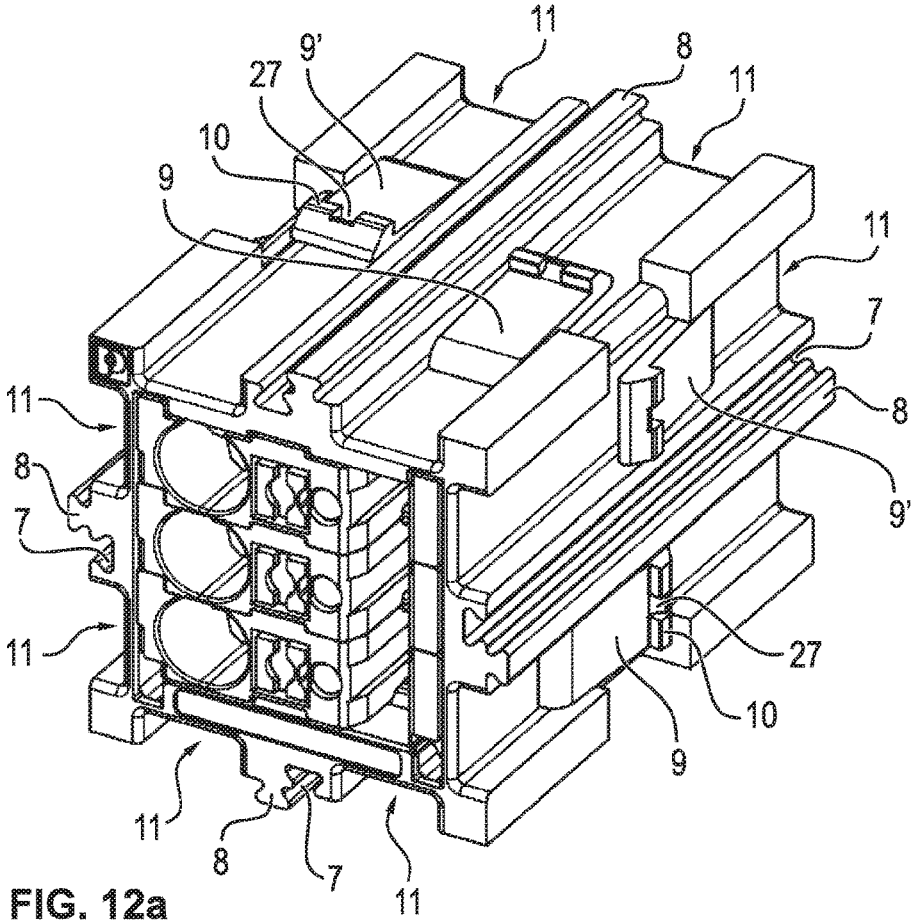
FIGS. 12*a* and 12*b* show an enlarged view of another exemplary embodiment of an individual socket block of a patchboard, in a perspective and from the front, respectively.
Figure 12B:
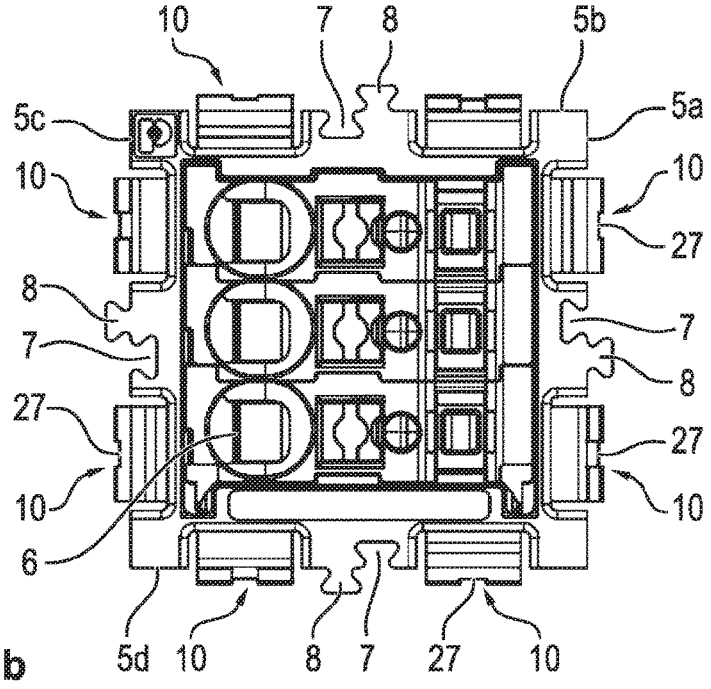

In another exemplary embodiment of a socket block 2 which is shown in FIGS. 12*a*, 12*b*, in the same manner as in the exemplary embodiment according to FIG. 11*a*, 11*b*, on the individual side faces 5*a*, 5*b*, 5*c*, 5*d* only one groove 7 and one ridge 8 at a time are made. On the two sides of the groove 7 made in the center and of the ridge 8, in this embodiment there is only one locating arm 9 and 9' so that in the socket block 2 according to FIGS. 12*a*, 12*b* as in the socket block according to FIG. 2*a*. 2*b*, per side face 5*a*, 5*b*, 5*c*, 5*d* there are two elastic locating arms 9, 9' at a time. Here too the elastic locating arms 9, 9' on their free ends each have one locating hook 10. In the exemplary embodiment according to FIGS. 12*a*, 12*b*, the individual locating hooks 10 each have a central recess 27 so that the locating hooks could also be called double locating hooks in this exemplary embodiment.

The latching of several socket blocks 2 according to FIG. 11*a*, 11*b* or of several socket blocks 2 according to FIG. 12 takes place essentially in the manner as has already been described and explained in conjunction with the socket block 2 shown in FIGS. 2*a*. 2*b*. To neutralize the latching, in the socket block 2 according to FIGS. 11*a*, 11*b* and 12*a*, 12*b*, a tool is inserted into the openings formed by two opposite recesses 11 between two socket blocks 2. The tool then deflects the respective locating arm 9, 9' such that the latching with the corresponding locating arm 9, 9' of the other socket block 2 is neutralized. Since in the socket blocks 2 which are shown in FIGS. 11*a*, 11*b* and 12*a*, 12*b* on the individual side faces 5*a*, 5*b*, 5*c*, 5*d* two recesses 11 at a time are made, a corresponding tool, in contrast to the tool 12 shown in FIG. 10, has not four, but a total of eight release arms 14. In addition, it is also possible to insert a single tool time, for example, the tip of a screwdriver, into each of the individual recesses 11 or the openings formed by two recesses 11 in order to neutralize the latching.

What is claimed is:

1. A patchboard, comprising:

a plurality of socket blocks, each of which has a box-shaped housing with two end faces each of which has at least one terminal region, and four side faces which extend between the end faces, each of which has at least one connecting element for connection to another socket block, the connecting elements being located on opposite ones of said side faces and being arranged corresponding to one another each having a longitudinal extension which runs parallel to a longitudinal extension of the respective side face, wherein on at least two bordering side faces of the socket blocks there is provided at least one elastic locating arm with a respective locating hook, the locating arms each extending in the direction of the longitudinal extension of the respective side face, wherein at least on the side faces on which at least one locating arm is provided, at least one recess is made in the side face by which the locating hook of one locating arm is accessible from one side face by means of a tool, wherein on at least two bordering side faces of the socket blocks, there are two elastic locating arms each of which has a respective locating hook, wherein the locating arms are located next to one another in the longitudinal extension of the respective side face and extend in opposite directions, and wherein the locating arms are made and arranged such that their ends overlap with the locating hooks in the longitudinal extension.

2. The patchboard as claimed in claims 1, wherein on each side face of the socket blocks at least one groove and at least one ridge corresponding to the groove is provided, at least the at least one groove on one side face being arranged mirror-symmetrically to at least one ridge on the opposite side face and at least one ridge on said one side face being arranged mirror-symmetrically to the at least one groove on the opposite side face.

3. A socket block for constructing a patchboard, comprising:

a box-shaped housing with two end faces and four side faces which extend between the end faces, the two end faces having at least one terminal region, and the side faces each having at least one connecting element for connection to another socket block, the connecting elements on opposite side faces being made and arranged corresponding to one another and the connecting elements each having a longitudinal extension which runs parallel to a longitudinal extension of the respective side face, wherein on each of at least two bordering side faces there is at least one elastic locating arm with a respective locating hook, the locating arms each extending in a direction of the longitudinal extension of the respective side face, and at least on the side faces on which the at least one locating arm is made, at least one recess for a tool is provided in the side face, wherein on at least two bordering side faces there are two elastic locating arms with a respective locating hook, wherein the locating arms are located next to one another perpendicular to the longitudinal extension of the respective side face and extend in opposite directions, and wherein the locating arms are made and arranged such that their ends overlap with the locating hooks in the longitudinal extension.

4. The socket block as claimed in claim 3, wherein the individual locating arms each have a first section and a connected second section, the first section being connected with a first end to the respective side face and the locating hook being made on the free end of the second section, and wherein the individual locating arms are made such that one locating arm is only deflected when a tool which has been introduced into the recess with its actuating tip meets the second section of the locating arm.

5. The socket block as claimed in claim 4, wherein in a transition region from the first section to the second section of the individual locating arms a bearing region is provided which is located spaced apart from the respective side face when the locating arm is not deflected and which rests against the respective side face of the socket block when the locating arm is being deflected by a tool which has been inserted into the recess.

6. The socket block according to claim 5, wherein the tool has at least two release arms and a handle section from which the release arms extend, the release arms being arranged relative to one another such that they can be inserted into two recesses at the same time on two different side faces of one socket block.

7. The socket block as claimed in claim 6, wherein the tool has four release arms which are located distributed symmetrically on the handle section.

8. The socket block as claimed in claim 6, wherein each of the release arms has two release fingers which are located next to one another in the longitudinal extension of the release arms, and each of which has a bevel on a free end of the arm, the bevels being located on opposing sides of the release fingers.

9. The socket block as claimed in claim 6, wherein at least one release arm has a locating hook which extends essentially perpendicular to a longitudinal extension of the release arm and which interacts with a corresponding edge on a socket block for latching of the tool on the socket block.

* * * * *